US005879242A

United States Patent [19]

Mendenhall

[11] Patent Number: 5,879,242

[45] Date of Patent: Mar. 9, 1999

[54] GOLF CLUB HEAD

[76] Inventor: Byron R. Mendenhall, 6233 Napoli Ct., Long Beach, Calif. 90802

[21] Appl. No.: 592,470

[22] Filed: Jan. 26, 1996

[51] Int. Cl.[6] ..... A63B 53/04

[52] U.S. Cl. ..... 473/328; 473/349; 473/350

[58] Field of Search ..... 473/328, 350, 473/349

[56] References Cited

U.S. PATENT DOCUMENTS

| | | | |
|---|---|---|---|
| D. 164,597 | 9/1951 | Penna . | |
| D. 211,100 | 5/1968 | Baker | 473/328 |
| D. 240,948 | 8/1976 | Redoutey | 473/328 |
| 1,089,881 | 3/1914 | Taylor | 473/328 |
| 1,505,296 | 8/1924 | Smith | 473/328 |
| 3,035,839 | 5/1962 | Coglianese . | |
| 3,539,184 | 11/1970 | Koorland . | |
| 3,858,886 | 1/1975 | Cosby | 473/350 |
| 3,967,826 | 7/1976 | Judice . | |
| 4,332,388 | 6/1982 | Crow | 473/328 |
| 4,932,658 | 6/1990 | Antonious | 473/350 |
| 4,938,470 | 7/1990 | Antonious . | |
| 5,106,087 | 4/1992 | Simmons | 473/287 |
| 5,183,255 | 2/1993 | Antonious | 473/314 |
| 5,425,535 | 6/1995 | Gee . | |
| 5,447,307 | 9/1995 | Antonious | 473/350 |
| 5,464,217 | 11/1995 | Shenoha | 473/350 |
| 5,492,327 | 2/1996 | Biafore, Jr. . | |
| 5,497,995 | 3/1996 | Swisshelm . | |

*Primary Examiner*—Sebastiano Passaniti
*Assistant Examiner*—Stephen L. Blau
*Attorney, Agent, or Firm*—Knobbe, Martens, Olson & Bear LLP

[57] ABSTRACT

A golf club head comprising a wedge has bottom and back surfaces having substantially aligned channels provided for reducing drag created by contact with the ground during a stroke. Of particular advantage in a hazard such as a sand trap, the channels facilitate flow of the sand from below to behind the club head such that greater, controlled force is imparted to the ball at or near the sweet spot of the club head. The bottoms of the heel and toe of the club head have sufficient mass with respect to the remainder of the club head that stability and resistance to torquing is provided. Thus, an increased control of the ball trajectory is achieved and more accurate positioning of the ball on the fairway is obtained.

17 Claims, 4 Drawing Sheets

GOLF CLUB HEAD

BACKGROUND OF THE INVENTION

The present invention relates to golf clubs, and, in particular, to a golf club head for use in golf's short game, including pitching wedges, lob wedges, sand wedges and the like.

In golf, amateurs and professionals alike endeavor to keep the ball in play on the fairway or trimmed grass areas of the golf course and hopefully end up on the green surrounding the hole, where the ball can then be more easily putted into the cup. However, virtually all players, at some point in a game, will end up with the ball close to but not on the green, and have to then hit the ball out of a hazard such as a sand trap or out of the "rough", or the area of taller or coarse grass.

Golf clubs referred to as wedges are used for this type of stroke, wherein the loft of the club head is substantially increased to provide a golf shot which has greater vertical height, less forward distance. That is, the angle between the vertical and a plane formed by the face of the club head is substantially greater than zero, and often about 50–60 degrees. The intent in having such a large loft is to hit the ball more upwardly so that it lands and remains on the green in a closer position to the hole. For all wedge types, a back spin will ideally be imparted on the ball which causes it to go up and out of the hazard, stopping on the green without too much forward travel. Pitching or lob wedges are used in a golfer's short game wherein the ball is on the fairway and only needs to be hit a short distance onto the nearby green. Such wedges may also be used to hit out of the rough, and sand wedges are used for hitting the ball out of a sand trap.

Rather than directly contacting the ball, the sand wedge is intended to hit the sand at about one inch behind the ball, just prior to contacting the ball. This type of shot cushions the ball so that it does not travel a great distance; however, it is hard to hit through sand or tall grass. Ground contact usually produces misalignment of the club head prior to hitting the ball, and the golfer's swing is made less smooth in the attempt to swing through the sand or grass. That is, because of the presence of loose sand or long grass, the wedge tends to be prematurely stopped by the entrapment of the ground between the wedge and the ball, so that the golfer's swing is either not completed or is not of desirable form.

To compensate, many golfers will avoid all but minimal contact with the ground by the wedge, so that the ball hits near the bottom edge of the face of the club head, well below its "sweet spot". The result is less than full force on the ball and reduced control of the resultant trajectory of the ball. The ball then travels more horizontally than vertically and may end up in another hazard or otherwise positioned detrimentally with respect to the number of additional strokes required to get to the end of the hole. Consequently, there exists a dilemma in the golfer's short game, wherein the golfer must exercise great control and a certain finesse in order to accurately place the ball in a desirable position on the nearby green, and yet he or she is also aware of the difficulty in hitting out of the sand or grass and therefore feels a need to hit the ball harder.

One attempt to overcome the entrapment of the ground by the wedge at a hazard comprises a golf club head having a pair of rails on the bottom surface or sole. The rails extend below the face of the club head, effectively raising the face off the ground. However, in actual use these rails tend to become entangled with or entrapped by the ground, therefore having an opposite effect than that intended. That is, the force imparted to the ball by the club head is reduced. There is a misalignment from the sweet spot of the club face and control over the ball trajectory is thus diminished.

SUMMARY OF THE INVENTION

The golf club head of the present invention generally comprises a wedge having a channel or depression formed on at least a back surface which creates a pathway or clearance for the ground, thereby reducing the resistance to the club head during a stroke and increasing control over the contact of the club head with the ball. Proper alignment of the club head is maintained throughout the swing, and additional force is unnecessary of particular advantage in a hazard such as a sand trap, the channel allows freer flow of the sand to behind the club head such that a greater force is imparted to the ball at or near the sweet spot of the club head. Since the wedges used in such hazards have relatively large lofts, the back of the club head is more likely to contact the ground during this stroke than are other types of golf clubs in other conditions. The golfer can more confidently hit behind the ball with less worry of the ground interfering with the golfer's stroke. Because of the reduced drag and pressure on the club head, the head can pass lower through the hazard (sand or tall grass), allowing contact with the sweet spot on the club face.

In a preferred embodiment, a golf club head comprising a sole and a back surface having substantially aligned channels formed thereon is provided for reducing drag created by contact with the ground during a stroke. An increased control of the ball trajectory is achieved, such that more accurate positioning of the ball on the adjacent fairway is obtained. Wide pads or feet formed on the bottoms of the heel and toe of the club head have sufficiently greater mass with respect to the remainder of the club head that stability and resistance to torquing is provided during contact with the ball.

In the preferred embodiment, the club head includes a pair of cavities which serve to reduce the mass of the upper portion of the club head and provide a lower center of gravity of the club head. Generally, the club head has a distribution of its mass such that the weight of the club head is generally consolidated along the bottom, with the bottom portions of the heel-hosel and toe preferably substantially equal in weight.

The bottom and back channels preferably taper so that from the face to the back the bottom channel widens and from the bottom to the top the back channel narrows providing advantageous flow characteristics. However, the channels may alternatively be curved or tapered in the opposite directions, or may take on a wide variety of configurations, while not detracting from their functionality or utility. Also, in the preferred embodiment the back channel extends upwardly to the two cavities, in alternative embodiments the channel may extend to the top of the club head or terminate at a single cavity.

Further advantages and applications will become apparent to those skilled in the art from the following detailed description and the drawings referenced herein.

DETAILED DESCRIPTION OF THE PREFERRED EMBODIMENTS

Figure 1:
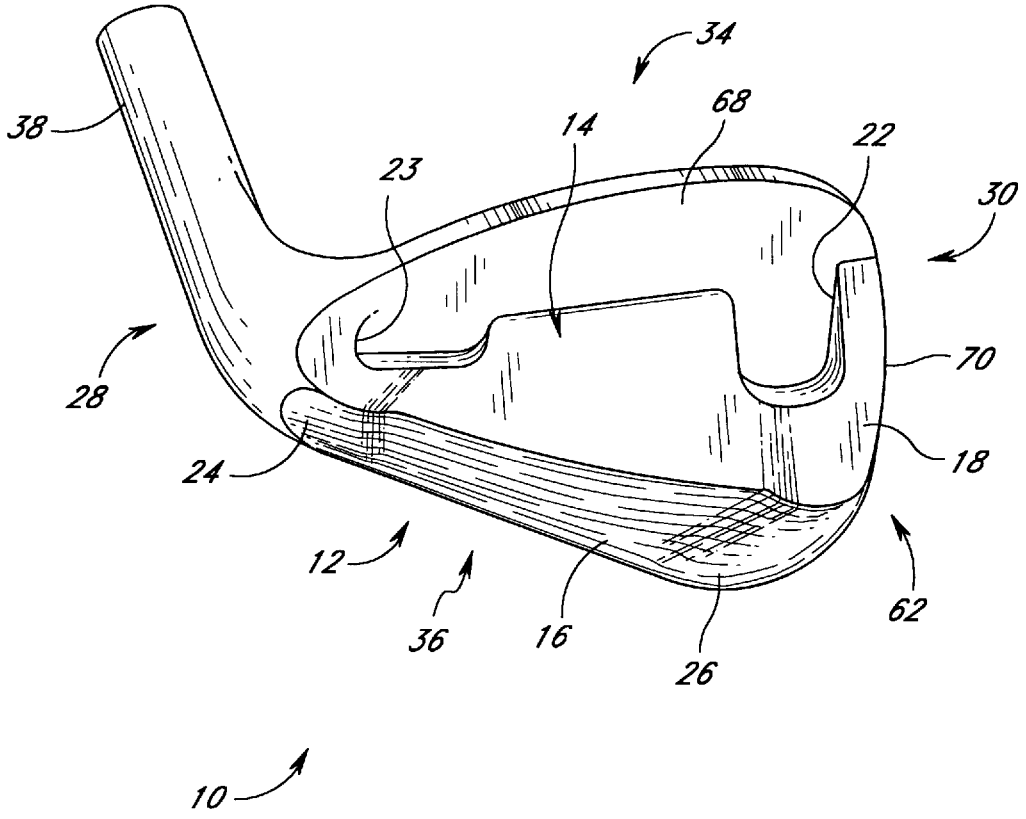
FIG. 1 is a rear perspective view of a golf club head in accordance with the present invention.
Figure 11:
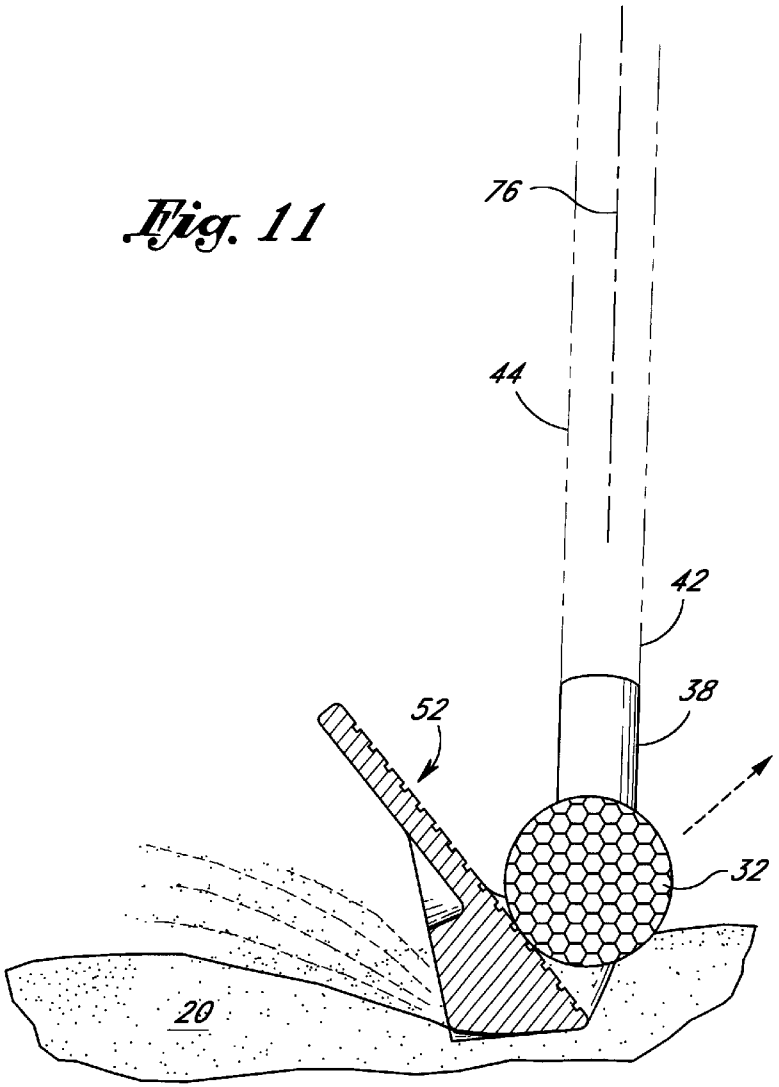
FIG. 11 is an end view of the club head contacting the golf ball.

A preferred embodiment of a golf club head of the present invention is shown in a rear perspective view in FIG. 1 and generally referenced by the numeral 10. In addition to a relatively large loft, the club head 10 comprises channels or depressions 12, 14 along its bottom and back surfaces 16, 18, respectively, which create an escape route for sand, dirt or grass 20 with which the club head 10 makes contact during a stroke, as shown in FIG. 11. Optional cavities 22, 23 on the back reduce the overall weight of the club head 10 and contribute to a lower center of gravity of the club head 10. Also, wide pads or feet 24, 26 formed on a heel 28 and toe 30 of the club head 10 provide greater stability and resistance to torquing when the club head contacts a golf ball 32.

Figure 2:
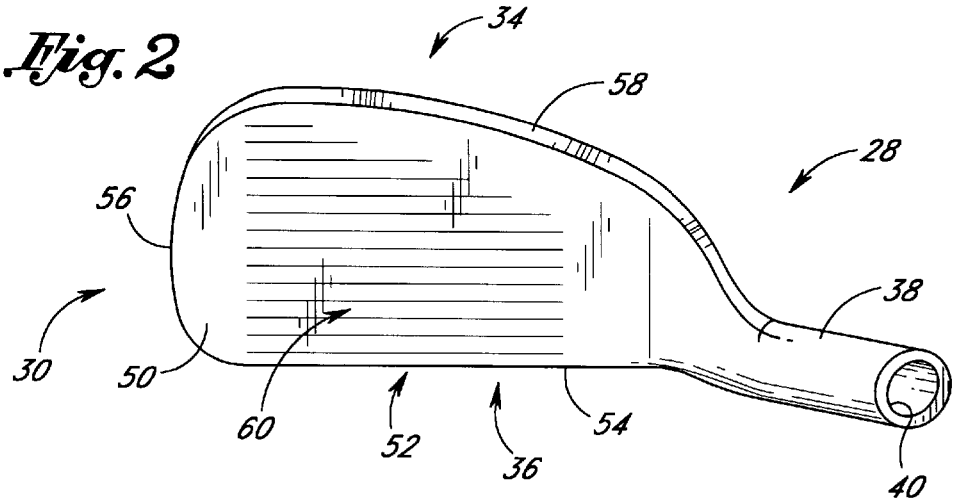
FIG. 2 is a top plan view thereof.
Figure 3:
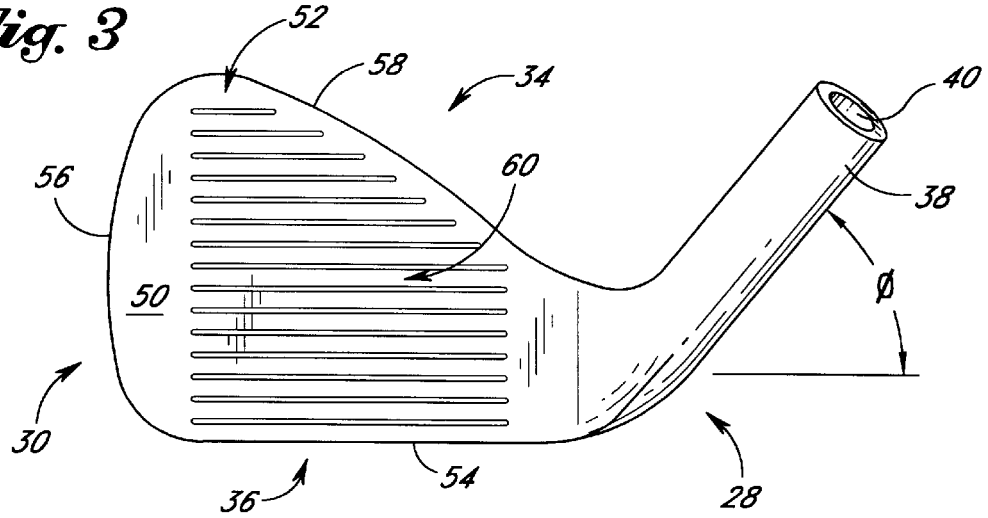
FIG. 3 is a front elevational view thereof.

Referring now to FIGS. 2 and 3, the club head 10 has a top 34 and a bottom 36. A hosel 38 is preferably integrally formed at the heel 28 and extends in a direction substantially away from the toe 30, forming a proximal end of the club head 10. A socket 40 formed at the end of the hosel 38 receives a lower end 42 of a golf club shaft 44 and is attached thereto by conventional means known to those skilled in the art. The wedge club head 10 is preferably formed of a metal of suitable strength and durability, and the club shaft 44 is typically a stainless steel or graphite composite. A grip or handle (not shown) at an upper end of the club shaft 44 may comprise a conventional covering known to those skilled in the art.

A face 50 on the front of the club head 10 preferably has a plurality of grooves 52 extending substantially parallel to a substantially straight bottom edge 54 and substantially across the face 50 from the toe 30 toward the heel 28. The grooves 52 provide a less smooth surface of the face 50 for better contact of the golf ball 32, and other patterns of grooves or the like may be substituted in alternative embodiments. The shape of the front face 50 may also differ in other embodiments, in that the curvature of a toe edge 56 may be greater or less, the radius formed between the toe edge 56 and an upper edge 58 may be greater or less and the upper edge 58 may be curved greater or less. Generally, a sweet spot 60 for imparting a more optimal force to the ball 32 is located on the face 50 in a region approximately one-quarter to one-third the distance from the bottom edge 54 to the upper edge 58 and approximately midway from the toe edge 56 to the hosel portion 38 of the heel 28.

Figure 7:
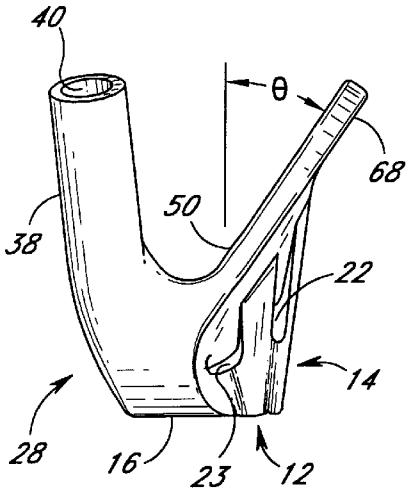
FIG. 7 is a right elevational view thereof.
Figure 5:
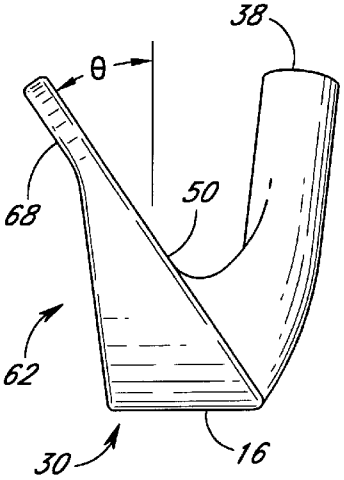
FIG. 5 is a left elevational view thereof.

This preferred embodiment of the club head of the present invention comprises a wedge 10 having a loft $\theta$ of approximately 52 degrees, more clearly seen in FIGS. 5 and 7. A lie $\phi$ of the club head, or angle of the club shaft 44 and hosel 38 to the horizon, is preferably about 70 degrees or less, as shown in FIG. 3. Club heads constructed in accordance with the present invention may have lofts and lies differing from the values of this preferred embodiment, as desired.

Figure 4:
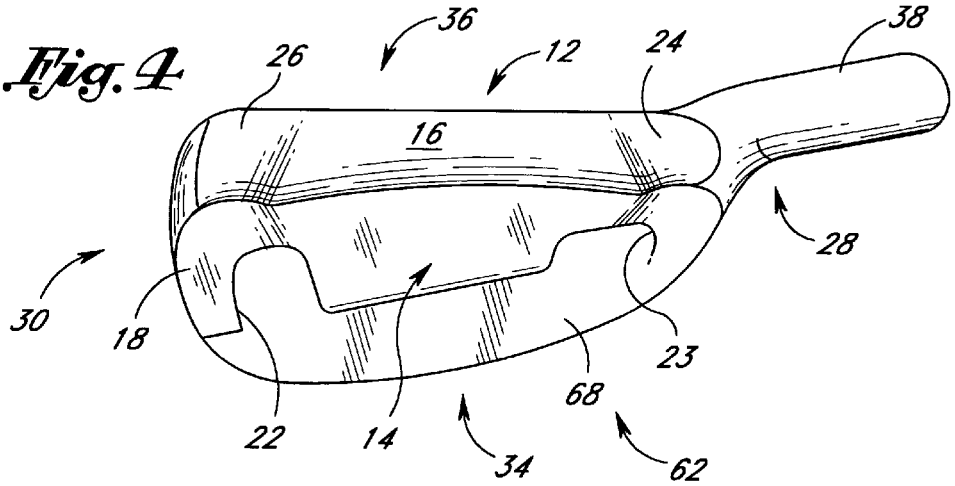
FIG. 4 is a bottom plan view thereof.
Figure 6:
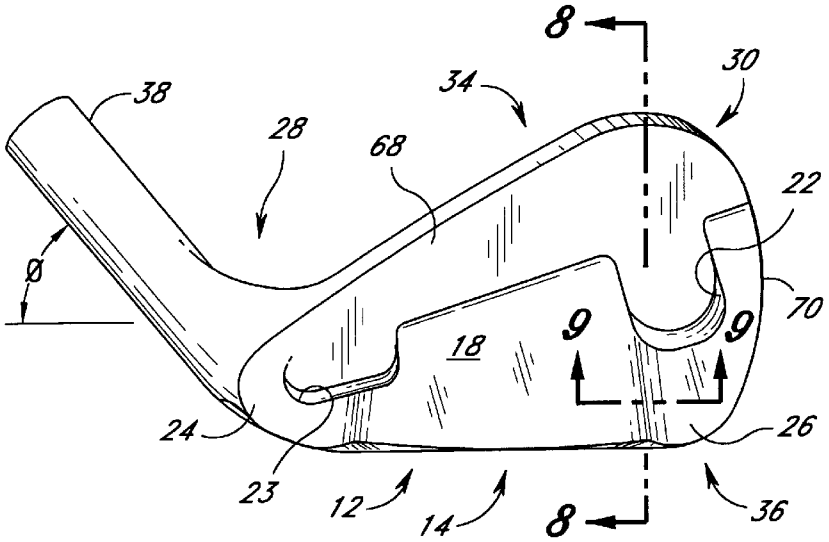
FIG. 6 is a rear elevational view thereof.

Referring now to FIG. 4, a back 62 and the bottom surface or sole 16 of the club head 10 are shown. As more clearly shown in FIG. 6, a depression or only a single channel 14 is formed on the back surface 18 which advantageously clears a path under the club head 10 for the ground 20 during a golf stroke thereby reducing the drag on the club head 10 prior to contact with the ball 32. Preferably, only a single channel 12 is formed on the sole 16 in substantial alignment with the back channel 14 such that the ground 20 has clearance beneath the club head 10 as soon as the face 50 has passed over it. Due to USGA regulations, the bottom edge 54 of the face 50 may not form part of the bottom channel 12. However, benefits from the present invention are obtained with only the back channel 14 of the club head 10. The back channel extends at least half the distance from the bottom to the top of the head.

As shown in FIG. 4, the sides of the bottom and back channels 12, 14 preferably taper so that from the face 50 toward the back 62 the bottom channel 12 widens, and from the bottom 36 to the top 34 the back channel 14 narrows, thus providing advantageous flow characteristics. (It should be noted that FIG. 4 shows the club head 10 rotated about the hosel 38 and a horizontal axis from the positions shown in FIGS. 2 and 3.) However, the sides of the channels 12, 14 may alternatively be more linear or curvy, they may taper in directions opposite those shown, or they may take on a wide variety of other configurations, while not detracting from their functionality or utility. Also, although in the preferred embodiment the back channel 14 extends upwardly to the two cavities 22, 23, in alternative embodiments the channel 14 may extend to the top 34 of the club head 10 or terminate at a single cavity (not shown).

Figure 9:
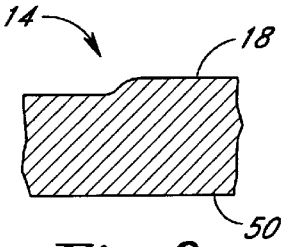
FIG. 9 is a detail cross-sectional view taken along lines 9—9 of FIG. 6.
Figure 8:
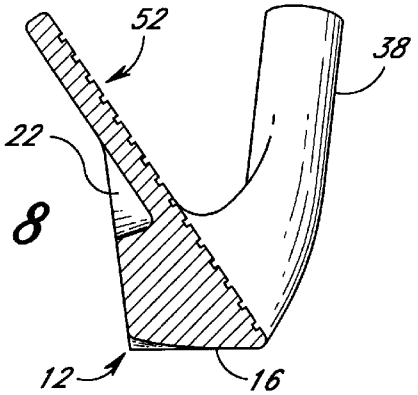
FIG. 8 is a cross-sectional view taken along lines 8—8 of FIG. 6.

FIG. 8 shows the bottom channel 12 on the sole 16 and FIG. 9 shows the back channel 14, both of which are preferably formed so that their sides are substantially smoothly continuous with the sole 16 or back surface 18, respectively. The channels 14, 12 also preferably comprise a substantial length of the back surface 18 and sole 16, respectively, from the heel 28 to the toe 30. Although, alternatively, the channels 14, 12 may have their sides formed by right angle or slanted edges on the back surface 18 and sole 16, and extend along a greater or less distance from the heel 28 to the toe 30 of the club head 10 than that of the preferred embodiment.

As indicated in FIG. 1 and more clearly shown in FIGS. 5 and 7, the distribution of the mass of the club head 10 is substantially consolidated in its bottom half. That is, the weight of the bottom 36 of the club head 10 is substantially greater than the weight of the top 34 of the club head 10. An upper back surface 68 which extends into the cavities 22, 23 is substantially parallel to the face 50 of the club head 10. A lesser or greater number of cavities may be included on the club head, and the cavities may comprise more rounded or more linearly shaped recesses than those shown. A toe edge 70 of the back surface 18 is preferably substantially vertical with respect to the horizon and the sole 16 of the club head 10.

Present wedges usually end up pushing a quantity of sand or such up along the lower edge of the club face such that the trapped sand interferes with the club head hitting the ball properly. Present wedges also often contact the ground such that the golfer tends to drag the club head over the ground in a manner which compresses the ground under the club head. The result is frictional contact of the club head with a boundary layer of the ground as well as pressure or resistance to flow or movement between lower layers of the ground. In both cases, the momentum of the golfer's swing is diminished as is the force imparted to the golf ball.

The back channel 14 of the present invention advantageously reduces the mass of the club head which would otherwise undesirably contact the ground. A path allowing freer movement of the ground is created and the golfer is better able to maintain alignment of the club head 10 and a smooth swing. Entrapment or compression of the ground during the attempt to hit the golf ball out of the hazard is significantly reduced and, because of the reduced drag and pressure on the club head 10, the head can pass lower through the sand or grass 20, allowing contact of the ball 32 with the sweet spot 60 on the club face 50.

Figure 10:
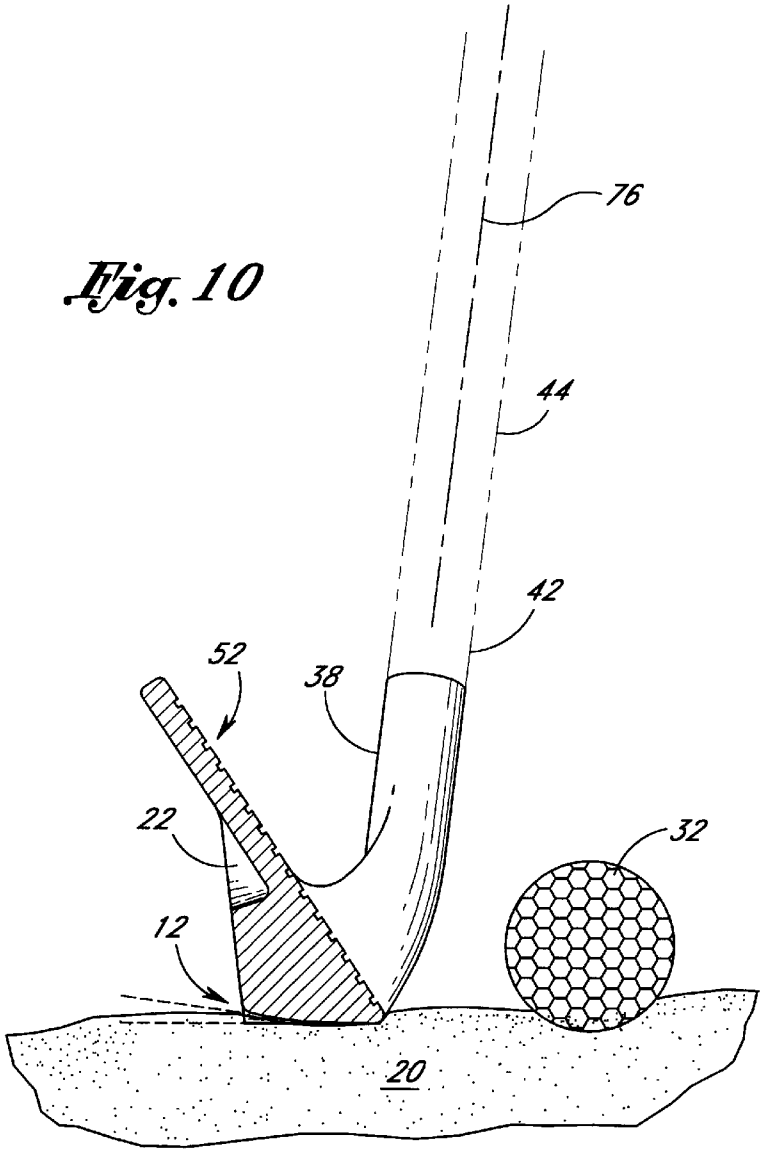
FIG. 10 is an end view of a golf club having a head of the present invention just prior to contact with a golf ball with the club head shown in cross-section.

The heel-hosel and toe portions 24, 26 formed in the preferred embodiment of the present invention have substantially equal weight such that stability about the sweet spot 60 is provided when the ball 32 is contacted. That is, when the ball 32 contacts the face 50, the moment caused by the ball 32 contacting the club head 10 is resisted by the mass at the toe 30 being accelerated in the opposite direction during the stroke, which produces a countermoment. Thus, there is improved resistance by the club head 10 to torquing about an axis 76 formed by the hosel 38 and shaft 44, as shown in FIGS. 10 and 11.

Thus, the channel back 14, especially in combination with the channel bottom 12, of the preferred embodiment of the present invention provides decreased drag on the club head 10 in contacting the sand or other hazard 20 and increased stability in contacting the golf ball 32. Greater control over the golf stroke is thereby produced so that the ball may be more accurately placed in position for further play.

The embodiments illustrated and described above are provided merely as examples of the golf club head of the present invention. Other changes and modifications can be made from the embodiments presented herein by those skilled in the art without departure from the spirit and scope of the invention, as defined by the appended claims.

What is claimed is:

1. A golf club head for attachment to a shaft of a golf club and for hitting a golf ball on the ground in a stroke, said head comprising:

a heel and a toe of said head, said heel having a portion adapted to fixedly receive said shaft of said golf club;

a front and a back of said head, said front having a face with a substantially straight bottom edge, said back having a surface with only a single continuous channel formed thereon; and a top and a bottom of said head, said bottom having a surface forming a sole with only a single continuous channel formed thereon;

wherein said bottom channel extends at least half the distance from said heel to said toe and terminates at feet formed at opposite ends of said channel, said bottom channel extending from said bottom edge of said face backwardly from said bottom edge and is tapered so as to become wider as it approaches said back of said head;

and said back channel extends at least half the distance from said bottom toward said top, said bottom and said back channels being substantially aligned to create a pathway for said ground thereby reducing resistance by said ground to said head during said stroke and increasing control over contact of said head with said ball and its resultant trajectory.

2. A golf club head for attachment to a shaft of a golf club and for hitting a golf ball on the ground in a stroke, said head comprising:

a front and a back of said head, said front having a face with a substantially straight bottom edge, said face substantially forming a plane having an angle from vertical that is greater than ten degrees, said back having a surface with a single channel formed thereon; and a top and a bottom of said head, said bottom having a surface forming a sole with only a single channel formed thereon;

wherein said bottom channel extends from a bottom edge of said face backwardly and sidewardly and terminates sidewardly at pads formed on said bottom at approximately said heel and toe and said back channel and said bottom channel being substantially aligned to create a pathway for said ground thereby reducing resistance by said ground to said head during said stroke and increasing control over contact of said head with said ball and its resultant trajectory and said back channel extends at least half the distance from said bottom toward said top.

3. A golf club head for attachment to a shaft of a golf club and for hitting a golf ball on the ground in a stroke, said head comprising:

a front and a back of said head, said front having a face with a substantially straight bottom edge, said face forming a plane having an angle from vertical that is greater than ten degrees, said back having a surface with only a single channel formed thereon; and a top and a bottom of said head, said bottom having a surface forming a sole of said head;

an only single bottom channel formed on said sole wherein said bottom channel extends from a bottom edge of said face backwardly and said back channel extending a maiority of the distance of said back surface from said bottom toward said top said back channel providing a clearance for said ground to pass under said head thereby reducing resistance by said ground to said head during said stroke and increasing control of said head during contact with said ball.

4. The golf club head of claim 3, wherein said sole channel extends at least half the length of said sole between said heel to said toe.

5. The golf club head of claim 3, wherein said sole channel is wider at the intersection with said back surface of said head than at the intersection with said face of said head.

6. The golf club head of claim 3, wherein said back channel is wider at the intersection with said sole and is more narrow toward said top of said head.

7. The golf club head of claim 3, wherein said back surface has at least one cavity formed thereon.

8. The golf club head of claim 3, wherein said angle of said plane of said face is approximately 52 degrees from vertical.

9. The golf club head of claim 3, further comprising a heel and a toe of said head, said heel having a socket for receiving said shaft formed on a portion of said heel which is furthest from said toe.

10. The golf club head of claim 9, wherein said head has a distribution of its mass such that the weights of said heel and toe are substantially the same and the weight of said bottom is greater than said top.

11. A golf club head for attachment to a shaft of a golf club and for hitting a golf ball on the ground in a stroke, said head comprising:

a front and a back of said head, said front having a face with a substantially straight bottom edge, said face forming a plane having an angle from vertical that is greater than ten degrees;

a top and a bottom of said head, said bottom having a surface forming a sole having only a single channel formed thereon extending from a bottom edge of said face backwardly; and a heel and a toe of said head, said channel formed between bottom portions of said heel and toe, a distribution of the mass of said head being such that the weights of said heel and toe are substantially the same and the weight of said bottom is greater than said top;

wherein said bottom heel portion and said bottom toe portion provide stability and prevent torquing of said head during said stroke thereby increasing control of said stroke and an only single channel formed on said back extending at least half the distance from said bottom toward said top.

12. A golf club head for attachment to a shaft of a golf club and for hitting a golf ball on the ground in a stroke, said head comprising:

a front and a back of said head, said front having a face with a substantially straight bottom edge;

a top and a bottom of said head, said bottom having a surface with only a single continuous channel formed thereon; and said channel extending from said bottom edge of said face backwardly and sidewardly, said channel providing a clearance for said ground to pass under said head thereby reducing resistance by said ground to said head during said stroke and increasing control of said head during contact of said face with said ball and an only single channel formed on said back extending at least half the distance from said bottom toward said top.

13. The golf club of claim 12, wherein said back channel tapers to become narrower as the channel extends upwardly from the bottom.

14. The golf club head of claim 12, wherein said bottom and back channels are substantially aligned to create a pathway for said ground thereby reducing said resistance by said ground to said head during said stroke.

15. The golf club of claim 12, wherein said bottom channel is tapered.

16. The golf club of claim 12, wherein said bottom channel becomes wider as it moves backwardly from said bottom edge of said face.

17. The golf club of claim 12, wherein said bottom further comprises feet formed thereon.

* * * * *